US005540993A

United States Patent [19]

Hernandez

[11] Patent Number: 5,540,993

[45] **Date of Patent: * Jul. 30, 1996**

[54] RELATING TO FIBER IDENTIFICATION

[75] Inventor: Ismael A. Hernandez, Winterville, N.C.

[73] Assignee: E. I. Du Pont de Nemours and Company, Wilmington, Del.

[ * ] Notice: The term of this patent shall not extend beyond the expiration date of Pat. No. 5,540,994.

[21] Appl. No.: 458,944

[22] Filed: Jun. 2, 1995

Related U.S. Application Data

[63] Continuation-in-part of Ser. No. 399,284, Mar. 6, 1995, abandoned, which is a continuation-in-part of Ser. No. 17,545, Feb. 16, 1993, abandoned.

[51] Int. Cl.[6] ..... D02G 3/00

[52] U.S. Cl. ..... 428/376; 428/397; 428/42; 428/398

[58] Field of Search ..... 428/376, 397, 428/398, 92

[56] References Cited

U.S. PATENT DOCUMENTS

| | | | |
|---|---|---|---|
| 3,493,459 | 7/1970 | McIntosh | 428/398 |
| 3,745,061 | 7/1973 | Champaneria | 428/398 |
| 3,772,137 | 11/1973 | Tolliver | 428/398 |
| 4,020,229 | 4/1977 | Cox, Jr. | 428/398 |
| 4,281,042 | 7/1981 | Pamm | 428/288 |
| 4,304,817 | 12/1981 | Frankosky | 428/362 |
| 4,520,066 | 5/1985 | Athey | 428/288 |
| 4,743,189 | 5/1988 | Samuelson . | |
| 4,818,599 | 4/1989 | Marcus | 428/362 |
| 4,850,847 | 7/1989 | Samuelson . | |
| 4,941,812 | 7/1990 | Samuelson . | |
| 4,956,237 | 9/1990 | Samuelson . | |
| 4,961,661 | 10/1990 | Samuelson . | |
| 5,104,725 | 4/1992 | Broaddus | 428/398 |
| 5,190,821 | 3/1993 | Goodall et al. | 428/398 |
| 5,230,957 | 7/1993 | Lin | 428/398 |

FOREIGN PATENT DOCUMENTS

| | | |
|---|---|---|
| 57-56512 | 4/1982 | Japan . |

*Primary Examiner*—N. Edwards

[57] ABSTRACT

Fiberfill and/or multi-void fibers are identified and/or differentiated by one or more voids being partially filled with a differentiating characteristic that is a protuberance of characterizing polymer material. This material may be the same or different from that of the rest of the fiber. The protuberance is provided by appropriate adjustment of the spinning capillary, i.e., during extrusion to form the fiber.

6 Claims, 10 Drawing Sheets

RELATING TO FIBER IDENTIFICATION

CROSS-REFERENCE TO RELATED APPLICATION

This application is a continuation-in-part of my application Ser. No. 08/399,284, filed Mar. 6, 1995, abandoned, and that is itself a continuation-in-part of my application Ser. No. 08/017,545, filed Feb. 16, 1993, now abandoned.

FIELD OF INVENTION

This invention concerns improvements in and relating to fiber identification, and includes a novel method of making a multi-void fiber with a characteristic by which it can later be identified, novel multi-void fibers so marked as to be identifiable, and products and materials including such marked fibers, especially fiberfill filling materials (often referred to shortly as "fiberfill") and products, including batts, fiberballs and other products comprising such marked fibers and materials comprising them, and processes and apparatus for obtaining such multi-void fibers and their products and materials.

BACKGROUND OF THE INVENTION

A fiber manufacturer's customers demand consistency in performance from the fibers provided by the manufacturer. In other words, the manufacturer's customers require that the properties of any particular fiber not vary appreciably from batch to batch of that fiber as the different batches of that fiber are produced over several years. The fiber manufacturer, however, has a need to be able to identify fiber from different production batches, while maintaining the consistency and uniformity that the customers require. Much notoriety has been given to fiber identification in criminology, for example, as a way to bring murderers or other criminals to justice. Manufacturers also, however, have other more mundane and practical reasons for needing to identify the production batch of particular fibers. So it has long been desirable to find a cheap yet effective system for identifying fibers. Previously, for instance, one method has been to add a chemical or nuclear marker to the fiber, but this method has added expense and complications and has had disadvantages, such as the ease with which some one other than the fiber manufacturer can add the same marker, after manufacture, and so confuse this system for identification.

In particular, there has long existed a need for an economical way to identify and differentiate resilient multi-void fibers (especially polyester multi-void fibers) that are crimped and used as fiberfill in products such as batts, fiberballs and other filling materials and filled articles, such as pillows, filled apparel, comforters, cushions and such like bedding and furnishing material. As indicated, it is important that any identifier system should not change the performance and properties of the fibers.

Examples of such crimped multi-void resilient filling fibers include those disclosed by Champaneria et al in U.S. Pat. No. 3,745,061, and in EP A2 0 067 684 (Jones et al), having 4 voids (sometimes referred to as holes) with a solid axial core, and by Broaddus in U.S. Pat. No. 5,104,725, having 7 or more voids, arranged with a central void and other voids arranged around the central void. Both 4-void and 7-void polyester filling fibers have been produced and sold commercially, and have been used as fiberfill. Broaddus compared properties of fiberfill comprising his 7-void filling fibers with those of fiberfill comprising prior commercial 4-void filling fibers and also with those of fiberfill comprising hollow filling fibers. The most important properties to compare for use as fiberfill are the bulk properties; measurement of bulk properties (referred to as TBRM for "Total Bulk Range Measurement") have been described, e.g., by Tolliver in U.S. Pat. No. 3,772,137, and so have frictional properties (that were also measured by Broaddus and are also important for fiberfill). Both of these crimped multi-void filling fibers have shown significant advantages over resilient crimped hollow filling fibers (such as disclosed by Tolliver in U.S. Pat. No. 3,772,137) in their performance as filling materials, especially when such multi-void filling fibers have had a smooth round peripheral surface. The disclosure of each of the above patent specifications is expressly included herein by reference.

In addition to the 4-void and 7-void filling fibers that were already commercially available, multi-void filling fibers have recently been invented with a smooth round peripheral surface and with only three longitudinal voids, as disclosed by Hernandez et al. in allowed application Ser. No. 08/315,748 (DP-6320), filed Sep. 30, 1994, the disclosure of which is also included herein, by reference.

SUMMARY OF THE INVENTION

The present invention solves this need to identify and differentiate multi-void fibers by providing a visual identifying marker in the configuration of the cross-section of the multi-void fiber. This marker identifies the multi-void fiber only visually, i.e., without significantly affecting performance of the fiber. Fibers with such a visual identifying marker according to the present invention are often referred to herein as "identifier fibers" (or "identifier filaments").

The terms "fiber" and "filament" are often used herein inclusively, without intending that use of one term should exclude the other.

Accordingly, this invention provides multi-void fibers that are of a synthetic polymer, that have at least four continuous voids throughout their fiber length, and that have a multi-void cross-section that shows characteristic polymer material that protrudes into one or more of the voids from an inside surface of the void or voids.

This invention also provides multi-void fibers that are of a synthetic polymer, that have three continuous voids throughout their fiber length, and that have a multi-void cross-section that shows characteristic polymer material that protrudes into one or more of the voids from an inside surface of the void or voids.

According to other aspects disclosed herein, fiberfill (and including filled articles thereof) is provided wherein said fiberfill comprises resilient crimped multi-void filling fibers of synthetic polymer, and wherein, e.g., at least 10 percent by weight of said fibers have a multi-void cross-section which shows that one or more such void contains (i.e., is partially filled with) characteristic protruding polymer material (i.e., that protrudes from an inside surface into such partially-filled void), whereby said characteristic protruding polymer material differentially identifies said fiber from a multi-void synthetic polymer fiber whose multi-void cross-section is similar except that it does not contain any such characteristic protruding polymer material and wherein the bulk properties of said fiber as filling material are essentially similar to the bulk properties of such a multi-void synthetic polymer fiber that is of similar cross-section except that it does not contain any such characteristic protruding polymer material; such multi-void fibers may contain, respectively, at least four continuous longitudinal voids (i.e., throughout their fiber length), or three such continuous longitudinal voids, as will be understood.

For example, fiberfill filling material is provided comprising resilient crimped multi-void filling fibers that are of a synthetic polymer and that have at least four continuous longitudinal voids, and being identified by a predetermined proportion of said fibers having their multi-void cross-section show characteristic polymer material that protrudes into a predetermined number and predetermined pattern of such void or voids from an inside surface of said such void or voids.

Also, fiberfill filling material is provided comprising resilient crimped multi-void filling fibers that are of a synthetic polymer and that have three continuous longitudinal voids, and being identified by a predetermined proportion of said fibers having their multi-void cross-section show characteristic polymer material that protrudes into a predetermined number and predetermined pattern of such void or voids from an inside surface of said such void or voids.

Polymer material protruding from a surface of a wall of an internal void of a (first) multi-void fiber of a synthetic material is used to identify said (first) multi-void fiber and differentiate it from other multi-void fibers of similar cross-section and having similar bulk properties to those of the first (identified and differentiated) multi-void fiber, except, of course, that the other multi-void fibers do not have the polymer material protruding from a surface of a wall of an internal void.

There is provided a multi-void synthetic polymer fiber, having at least four continuous longitudinal voids, wherein the multi-void cross-section of the fiber shows that one or more such void is partially filled with characteristic polymer material that protrudes from a wall into such partially-filled void, whereby said characteristic protruding polymer material differentially identifies said fiber from similar multi-void synthetic polymer fibers that do not contain any such protruding polymer material but does not significantly differentiate the performance properties of said fiber from said similar fibers.

Also, there is provided a multi-void synthetic polymer fiber having three continuous longitudinal voids, wherein the multi-void cross-section of the fiber shows that one or more such void is partially filled with characteristic polymer material that protrudes from a wall into such partially-filled void, whereby said characteristic protruding polymer material differentially identifies said fiber from similar multi-void synthetic polymer fibers that do not contain any such protruding polymer material but does not significantly differentiate the performance properties of said fiber from said similar fibers.

Other aspects include methods, apparatus and products disclosed herein.

Preferred features include using polyester polymer as the material for the synthetic polymer of the multi-void fiber and/or the characteristic polymer material, and preferably for both, including using the same polyester polymer for both, and using the invention for 4-hole fibers and/or 7-hole fibers, such as are disclosed in the art, and/or 3-hole fibers with a smooth round periphery, such as are disclosed in allowed application Ser. No. 08/315,748, especially any such multi-void fibers with only 1 of the holes (i.e., voids) partially filled.

BRIEF DESCRIPTION OF DRAWINGS

FIGS. 1 and 2 are magnified (625×) photographs of cross-sections of 4-void filaments, FIG. 1 being of preferred filaments according to the invention, whereas FIG. 2 is of prior art filaments for comparison, as discussed in Example 1.

FIGS. 4–7 are magnified photographs of cross-sections of 4-void filaments, FIGS. 4 and 5 being of preferred filaments according to the invention, whereas FIGS. 6 and 7 are of prior art filaments for comparison. FIGS. 4 and 7 are of magnification 500×. FIGS. 5 and 6 are of magnification 1000×. These are discussed in Example 3.

FIGS. 10–13 are magnified photographs of cross-sections of 3-void filaments, FIGS. 10 and 11 being of preferred identifier filaments according to the invention, whereas FIGS. 12 and 13 are of filaments without identifier, for comparison. FIGS. 10 and 12 are of magnification 500×. FIGS. 11 and 13 are of magnification 1000×. These are discussed in Example 4.

DETAILED DESCRIPTION OF THE INVENTION

In most respects, the fiberfill filling materials and resilient crimped multi-void filling fibers of the invention are prepared conventionally by methods known in the art, such as referred to herein. Preferred multi-void filling fibers are prepared from polyester polymers, especially poly(ethylene terephthalate), and this preferred embodiment is described herein more particularly, for convenience, it being understood that appropriate modification can be made by those skilled in the art for other synthetic polymers, such as polyamides or polypropylene, to take account of their differences, e.g., in melting conditions and properties, such as melt viscosity. One such disclosure in the art is Champaneria et al U.S. Pat. No. 3,745,061, which discloses multi-void synthetic filaments and a spinneret capillary for spinning such filaments containing four substantially equidimensional and equi-spaced parallel continuous voids from synthetic polymers, including polyesters, in FIG. 1 thereof.

Figure 1:
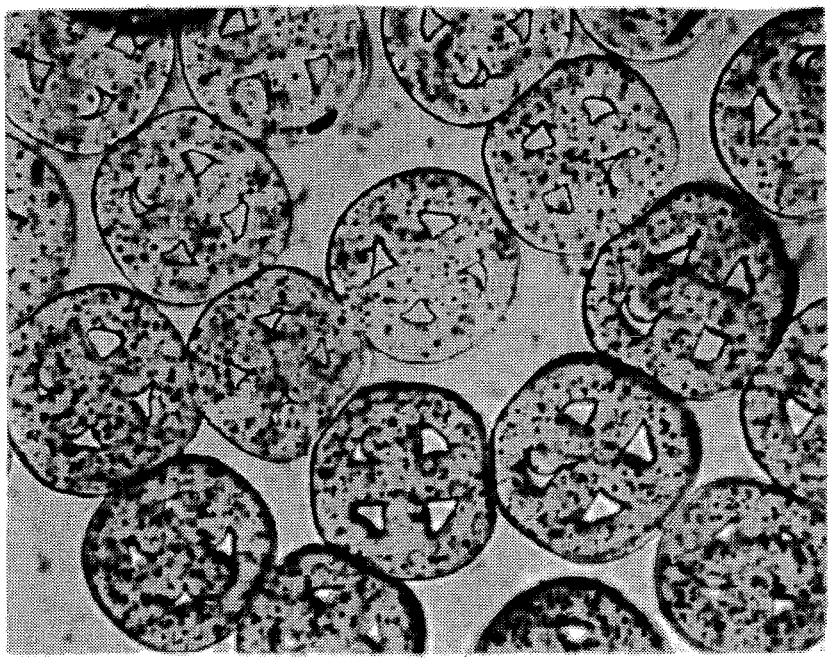
Figure 3:
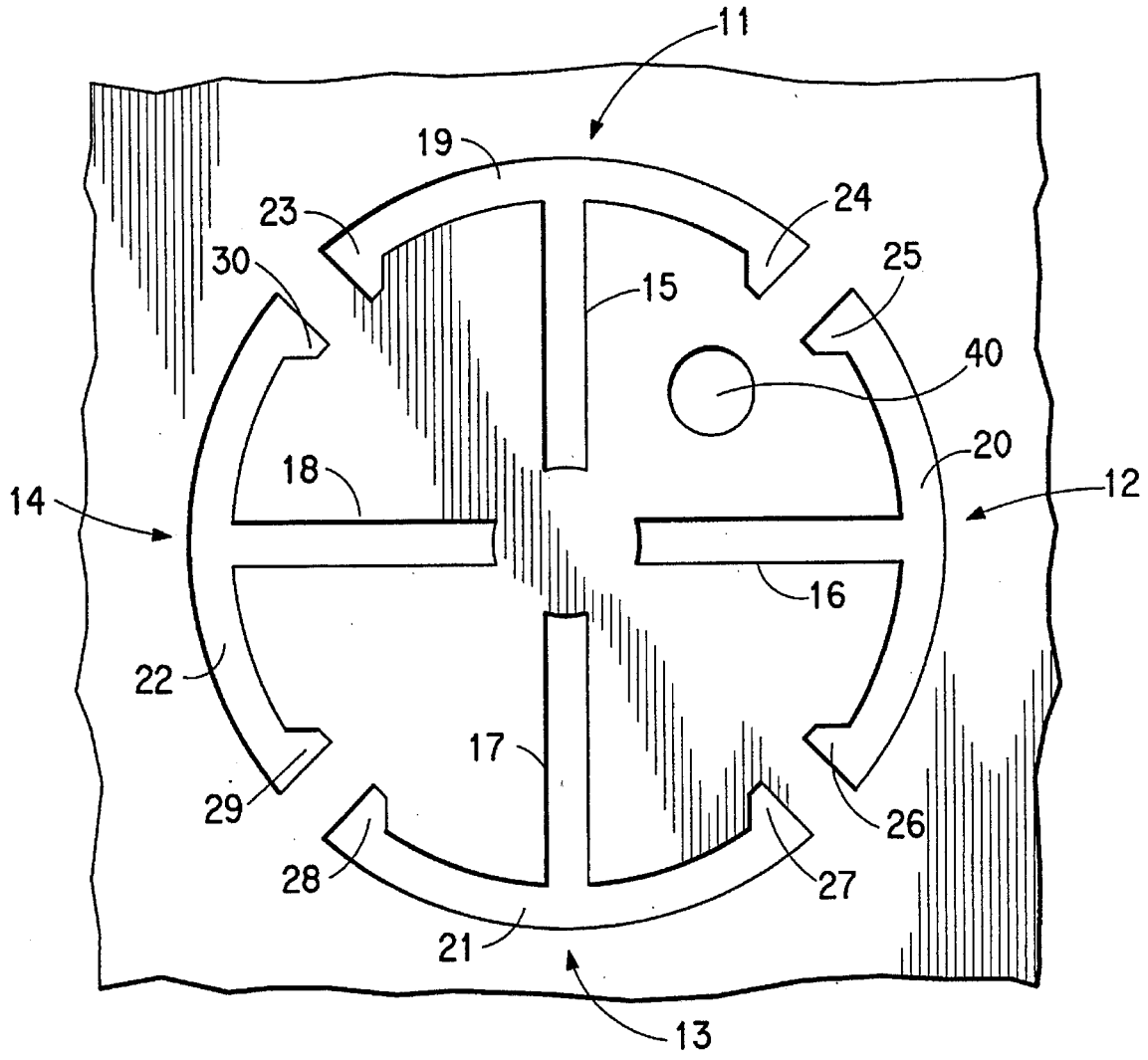
FIG. 3 is an enlarged view of a spinneret capillary, taken looking at the lower face of the spinneret, for spinning preferred 4-void filaments of the invention as in FIGS. 1, 4 and 5.

Referring to FIG. 3 of the accompanying drawings, showing an enlarged view of a spinneret capillary for spinning 4-void identifier filaments of the present invention, the similarity to that of FIG. 1 of Champaneria will be noted. The capillary is formed of four individual segments designated generally 11, 12, 13 and 14 in the form of T-shaped slots with four radial slots 15, 16, 17 and 18 radiating outwards to join outer peripheral slots 19, 20, 21, 22 that are curved to form arcs of an incomplete circle. At each end of each peripheral slot, 19, 20, 21 and 22, are enlarged "toes" 23 and 24, 25 and 26, 27 and 28, and 29 and 30, respectively, being enlarged ends of said slot to assist in post-coalescence of the emerging molten polymer to form the desired multi-void solid filament, as is known in the art, such as Tolliver, U.S. Pat. No. 3,772,137. An important and novel difference in FIG. 3 herein (that differentiates from FIG. 1 of Champaneria) is the provision of an orifice 40. Molten polymer extruded through orifice 40 solidifies and coalesces on an internal wall of one of the voids of the filament formed by post-coalescence of molten polymer extruded through slots 11, 12, 13 and 14, to form a protuberance partially filling one of the voids. The relative location of the protuberance within the void may vary along a length of the filament, as will be understood.

Figure 2:
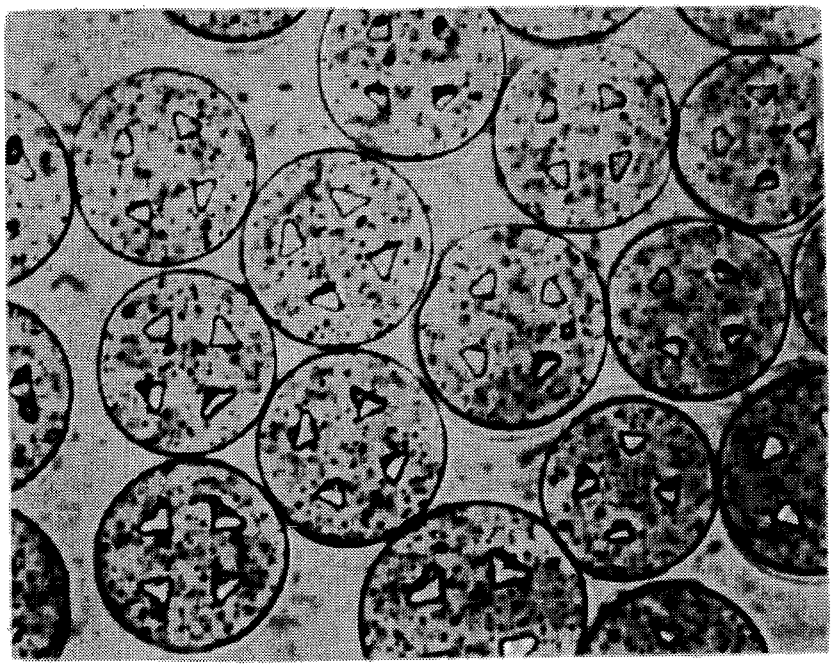

Magnified cross-sections of such identifier filaments of the invention, containing 4 voids, one of which is partially filled with polymer that protrudes from an internal wall of such void, are shown in FIG. 1, at 625× magnification. In contrast, similarly magnified cross-sections of conventional 4-void filaments are shown in FIG. 2. As mentioned, the cross-sections in FIGS. 1 and 2 have been greatly magnified. Fiberfill filaments are so fine that, without magnification, it is doubtful that anyone would be able to see any void in the cross-section, or whether the filament is solid, hollow, or multi-void, let alone be able to recognize if any void is partially filled with protruding polymer.

As may be seen from Examples hereinafter, both types of filaments can be prepared to have comparable performance and properties as filling materials. In other words, an objective has been achieved in this respect. This will be discussed more hereinafter.

To summarize this point, without preparing and examining greatly-magnified carefully-cut cross-sections and comparing the filaments, most people would be unable to determine significant difference between filaments of the invention and conventional filaments of the art. So the objective of the invention has been achieved economically by use of a different spinneret capillary to give the filament a different cross-sectional configuration internally, without affecting the exterior of the filament or its performance, i.e., wherein the difference can only be determined visually, after examining a greatly-magnified carefully-cut cross-section of the filament.

As will readily be understood, the invention lends itself to many variations. For instance the number and pattern of the protuberances in relation to the voids may be varied, especially with filaments having larger numbers of voids, such as 7 voids, bearing in mind that it has generally been thought desirable to maximize the void content to take advantage of the presence of the voids. It will generally be desirable for the protuberance to fill about 25 to about 50% of the volume of the void, and generally to extend to an amount of about 25 to 50% of the average web thickness of the filament between adjacent voids, bearing in mind the above, and the objective of having a characteristic that is relatively easy to detect visually, especially when using the same polymer material. It is not necessary to provide every filament (i.e., 100%) with identifier, but a regulated (i.e., predetermined) proportion (e.g., at least about 10% by weight) of particularly-identified filaments may be included, and recorded, for a batch of fiber that is sold. Furthermore, although it is less costly, so generally preferred, to spin filaments from a single polymer, so the polymer material is the same in the protuberance as in the rest of the filament, different polymers may be used, if desired, so as to provide better identification for merges or batches of fiber. In other words, fiberfill (one or more batches) according to the invention can be identified by providing a predetermined proportion (that may be recorded, and may vary up to 100%) of the constituent filling fibers with a predetermined number and predetermined pattern of voids containing visual identifier, i.e., characteristic polymer material protruding into, i.e., partially filling, such void(s), as described, and these details may all be recorded.

As mentioned above, and as demonstrated in the Examples, partially filling one or more voids of the multi-void filling fibers (according to the invention) did not significantly change the bulk properties or performance of the fibers as fiberfill. Applicant has also found that the extent to which the voids are filled has not significantly changed the bulk properties or performance. So long as all the voids remain to some degree, the bulk performance properties have not been significantly affected. This is different from what has been taught in the art for hollow fibers. So this was a new and surprising finding. In other words, partially filling one or more voids in a multi-void filling fiber (according to the invention) has not been found to affect the bulking properties of the multi-void filling fibers, whereas the art has taught that extruding extra polymer so it coalesces onto the internal surface of a hollow filament will change the bulkiness of the resulting hollow filament. In contrast to hollow fibers, it seems that it is the presence of the particular number of voids, located symmetrically or regularly around the cross-section of the multi-void fiber, rather than the relative sizes of the various voids in the cross-section, that determines the bulkiness.

The invention is further illustrated in the following Examples, all parts and percentages being by weight, unless otherwise indicated. The levels of coatings (slickeners and finishes) applied to the filaments were OWF (with regard to the weight of the fiber). Relative Viscosity (sometimes referred to as LRV) and void content (by volume, by a flotation method) were determined by the methods referred to in U.S. Pat. No. 4,712,988 (Broaddus et al.). Bulk measurements were determined by the method referred to in Tolliver U.S. Pat. No. 3,772,137 referred to hereinabove, and crimp measurements essentially as described therein.

Fiber-to-fiber friction values for fiberfill filling (staple) fibers are generally obtained by what is known as Staple Pad Friction (SPF) measurements.

As used herein, a staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass.).

The staple pad is prepared by carding the staple fibers (using a SACO-Lowell roller top card) to form a batt which is cut into sections, that are 4.0 ins in length and 2.5 ins wide, with the fibers oriented in the length dimension of the batt. Enough sections are stacked up so the staple pad weighs 1.5 g. The weight is of length (L) 1.88 ins, width (W) 1.52 ins, and height (H) 1.46 ins, and weighs 496 gm. The surfaces of the weight and of the base that contact the staple pad are covered with Emery cloth (grit being in 220 to 240 range), so that it is the Emery cloth that makes contact with the surfaces of the staple pad. The staple pad is placed on the base. The weight is placed on the middle of the pad. A nylon monofil line is attached to one of the smaller vertical (W×H) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/min. The staple pad, the weight and the pulley are also moved down with the base, which is mounted on the lower crosshead. Tension increases in the nylon monofil as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the Emery cloth at the interfaces with the staple pad, there is little relative motion at these interfaces; essentially any motion results from fibers within the staple pad moving past each other.) The threshold level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

EXAMPLE 1

Filaments were spun from poly(ethylene terephthalate) of relative viscosity (LRV) 20.4, at a polymer temperature of 291°–297° C., at 1195 ypm (1092 mpm), through a spinneret with 388 capillaries, at a throughput per capillary of 0.234 lbs./hr. (0.106 kg./hr.), using capillary orifice designs as shown in FIG. 3. The spun filaments were assembled to form a rope of 922,000 relaxed drawn denier. The rope was drawn in a conventional manner, using a draw ratio of 3.39× in a hot, wet spray draw zone maintained at 90° C. The drawn filaments were crimped to three different levels, i.e., to obtain three different levels of crimp, and correspondingly of bulkiness (namely, Support Bulk (i.e., bulk at 0.2 psi) heights of 0.6, 0.8 and 0.9 inches measured on a stack of carded webs, as described by Tolliver), in a conventional stuffer box crimper of cantilever type (3.5 in, 8.9 cm size), and the crimped ropes were relaxed in an oven at 180° C. before cutting. A conventional antistatic overlay finish of about 0.07% by weight was applied to every sample. The first (lowest bulk) fiber had, however, also been slickened before relaxing with a finish containing about 1% silicone per weight of fiber. The resulting filaments were all cut to staple of length 2 inches (5.4 cm). Cross sections of the resulting cut fibers of the invention are shown in FIG. 1, and show a solid axial core and four parallel continuous internal voids, one of which contains a protuberance on an inside surface of the void to serve as an identification mark. The outside peripheries of the fibers were round and smooth. The fibers were found to have an average void content of 17.1% and a denier per filament of about 5.5.

For comparison, these Samples of fibers of the invention were compared with current conventional 4-void fibers, of average void content 15.5%, crimped to similar levels of crimp (providing similar Support Bulk levels), of the same denier and which were made similarly, except for using a capillary similar to that of FIG. 3, herein, but without any orifice 40 for an identifier, in other words, similar to that in FIG. 1 of Champaneria, as discussed above. The cross-sections of these conventional fibers were similar to those of the invention (FIG. 1) except that all four voids were clear, i.e., there were no protuberances that act as identifier marks as shown in FIG. 1.

As indicated, the performance and properties of the two sets of fibers as fiberfill filling material were compared and found to be essentially similar, i.e., the bulkiness of each pair of the fiberfill samples was found to be similar, despite the differences in cross-section of the fibers. The friction measurements of the slickened fibers were, respectively, 0.265 and 0.293, i.e., essentially similar.

EXAMPLE 2

Two types of fibers (one according to the invention, with an identifier, and the other of conventional cross-section, without such identifier) were prepared essentially as described in Example 1, except that they were spun through spinnerets having 212 capillaries, and were of higher density. The void contents of the filaments, as drawn, were about 17.9% and 19.8%, respectively, and the relaxed drawn deniers were about 14.4 and 14.3, respectively, for the fiber of the invention (having the identifier) and the conventional fiber. The properties of both types of fibers were again compared and both fibers were found to have essentially the same properties, and the same performance as fiberfill.

EXAMPLE 3

Filaments were spun from poly(ethylene terephthalate) of relative viscosity (LRV) 20.4, at a polymer temperature of 291°–297° C. at 1277 ypm (1167 mpm), through a spinneret with 363 capillaries, at a throughput per capillary of 0.278 lbs./hr. (0.126 kg./hr.), using capillary orifice designs as shown in FIG. 3 herein. The spun filaments were assembled to form a rope of 65,000 relaxed drawn denier. The rope was drawn in a conventional manner, using a draw ratio of 2.9× in a hot, wet spray draw zone maintained at 95° C. The drawn filaments were crimped to two different levels, to obtain two levels of crimp (and correspondingly two levels of bulkiness, namely Support Bulk, measured as described by Tolliver for carded webs in U.S. Pat. No. 3,772,137), as given for Sample A and for Sample C in TABLE A below, in a conventional stuffer box crimper of cantilever type (1.0 in, 2.5 cm size) and the crimped ropes were relaxed in an oven at 180° C. before cutting. A conventional antistatic overlay finish of about 0.15% per weight was applied to every sample. The resulting filaments were all cut to staple of length 2 inches (5.4 cm).

Figure 4:
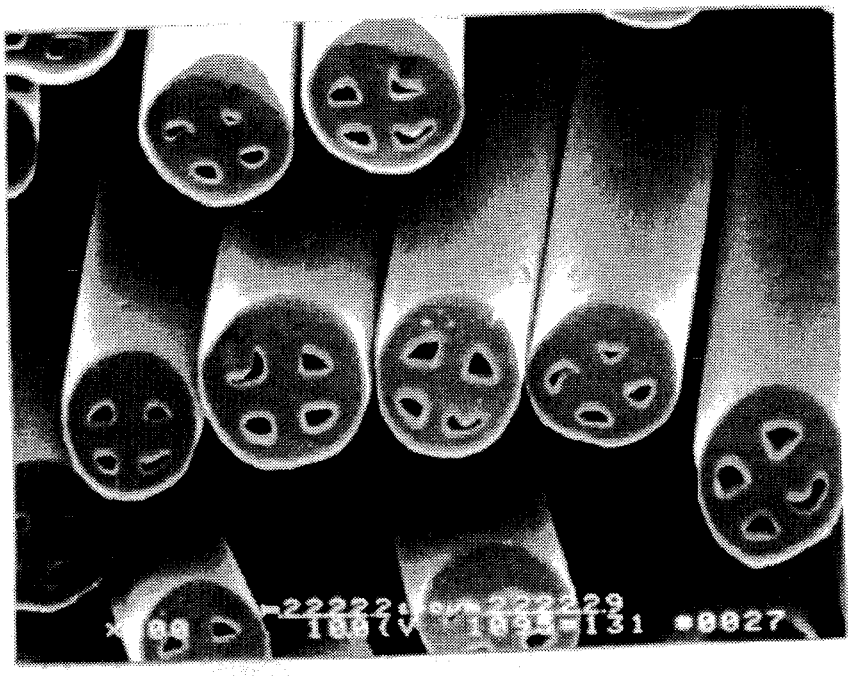
Figure 5:
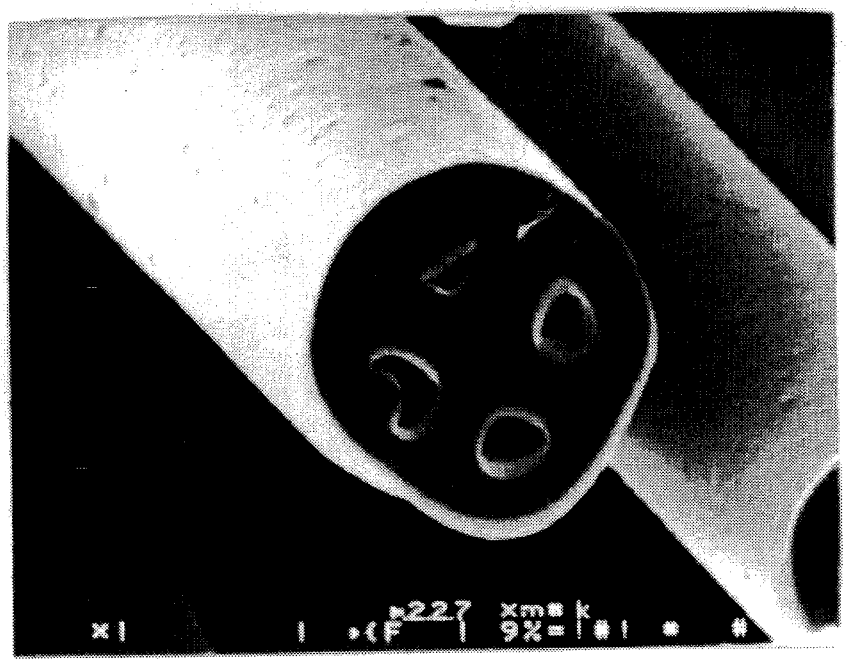

Cross-sections of the resulting cut identifier fibers are shown in FIGS. 4 and 5. Each such filament contains a solid axial core and four parallel continuous voids, one of which contains a protuberance of an inside surface of the void to serve as an identification mark. These fibers have a void content of about 12.5%.

Figure 6:
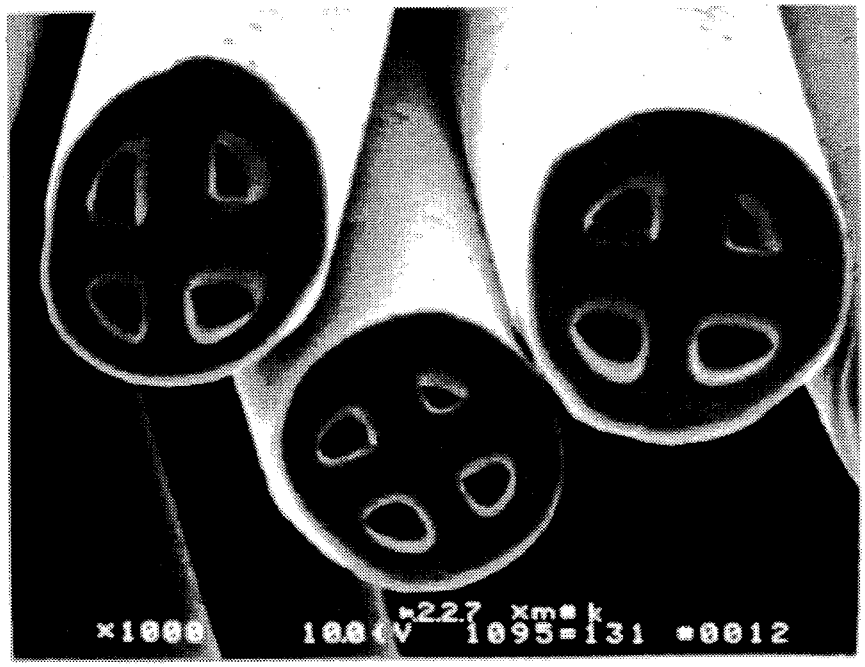
Figure 7:
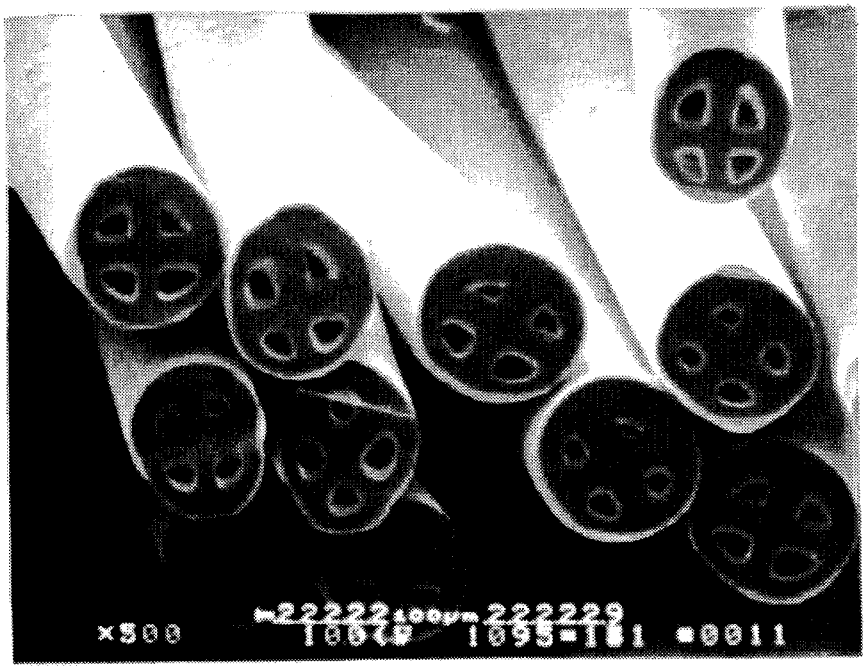

The above fibers were compared with current conventional 4-void fibers (crimped to similar levels of crimp, providing similar levels of bulkiness, as described above, as given for Sample B and for Sample D in TABLE A), of the same denier and which were made similarly, except for using a conventional capillary (without orifice 40, in other words, similar to FIG. 1 of Champaneria as discussed above). These conventional fibers are shown in FIGS. 6 and 7. These cross-sections were similar to those of the invention, except that they contain no fiber identification marker, i.e., there are no protuberances that act as identifier marks as shown in FIGS. 4 and 5.

Figure 8:
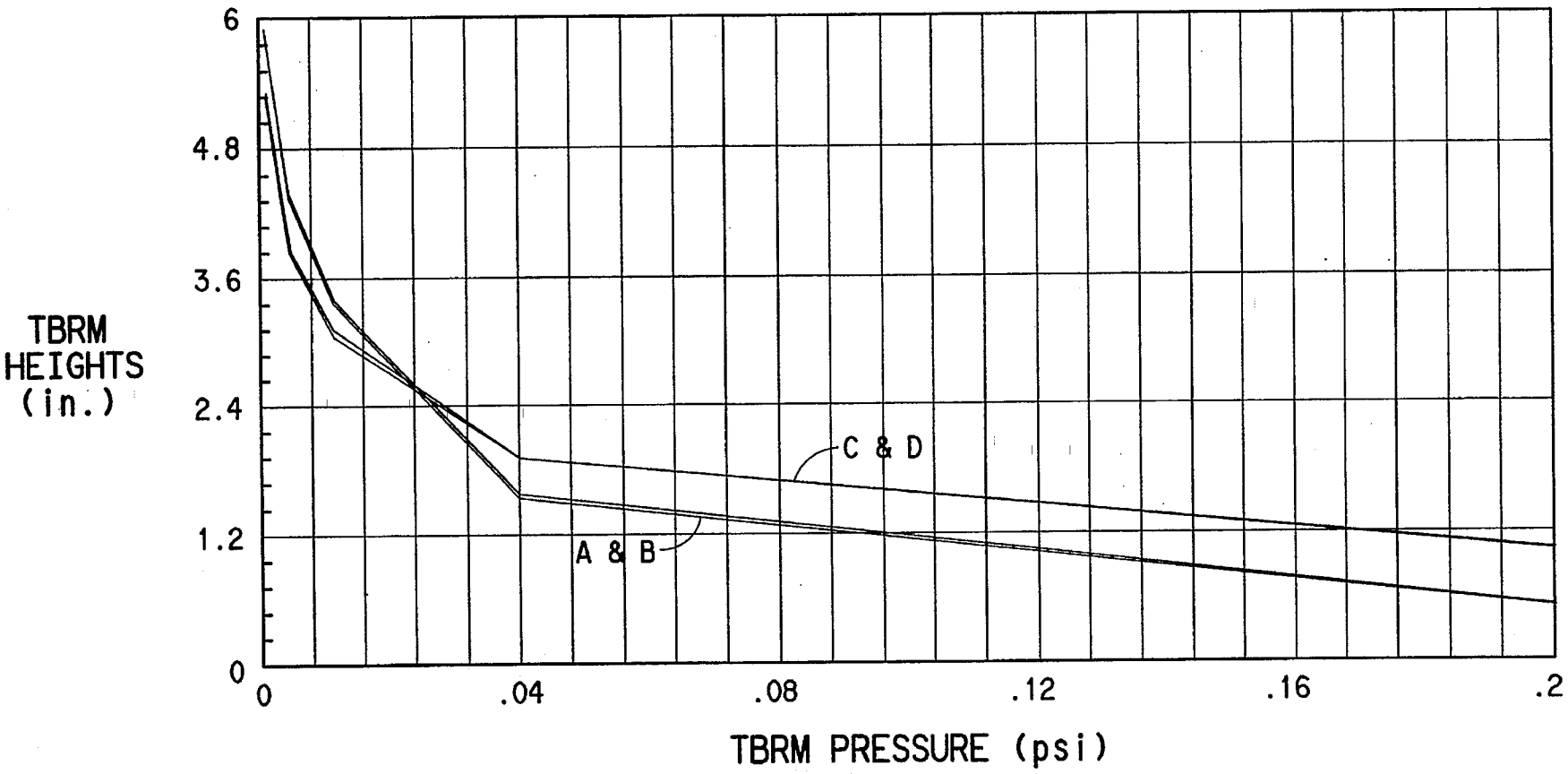
FIG. 8 is a graph plotting TBRM data, heights in inches versus pressures in psi, as discussed also in Example 3.

Sample A (identifier fibers) and Sample B (conventional fibers) were crimped to similar crimp levels of about 4.5 crimps per inch (CPI), and a Crimp Index (CHI) of about 7. Table A shows that the TBRM data measured for such Samples are very similar, so much so that, when the data are plotted on a graph, as shown in FIG. 8, Curves A and B are virtually indistinguishable. Similarly, Sample C (identified fibers) and Sample D (conventional fibers) were crimped to similar crimp levels of about 7 crimps per inch (CPI), and to a similar Crimp Index (CHI) of about 11, and give similar TBRM results (see Table A and FIG. 8). In other words, when these two types of fibers are crimped to similar crimp levels (similar CPI and CHI), the resulting bulkiness of the fibers (as measured by TBRM) is almost the same, despite the differences in their cross-sections, which are visible in magnified photographs, as shown in FIGS. 4 to 7.

TABLE A

| Pressure | Height (inches) under such Pressure | | | |
|---|---|---|---|---|
| (psi) | Sample A | Sample B | Sample C | Sample D |
| 0.001 | 5.930 | 5.944 | 5.295 | 5.311 |
| 0.005 | 4.316 | 4.387 | 3.816 | 3.855 |
| 0.010 | 3.370 | 3.425 | 3.098 | 3.132 |
| 0.040 | 1.588 | 1.609 | 1.869 | 1.879 |
| 0.20 | 0.500 | 0.527 | 0.813 | 0.822 |

As indicated hereinabove, a 3-void filling fiber with a smooth round peripheral surface has recently been invented and disclosed by Hernandez et al. in allowed application Ser. No. 08/315,748, filed Sep. 30, 1994, so the following Example 4 was performed to make 3-void filling fibers with and without identifiers in one of the voids, and to compare their properties and performance as fiberfill.

Figure 9:
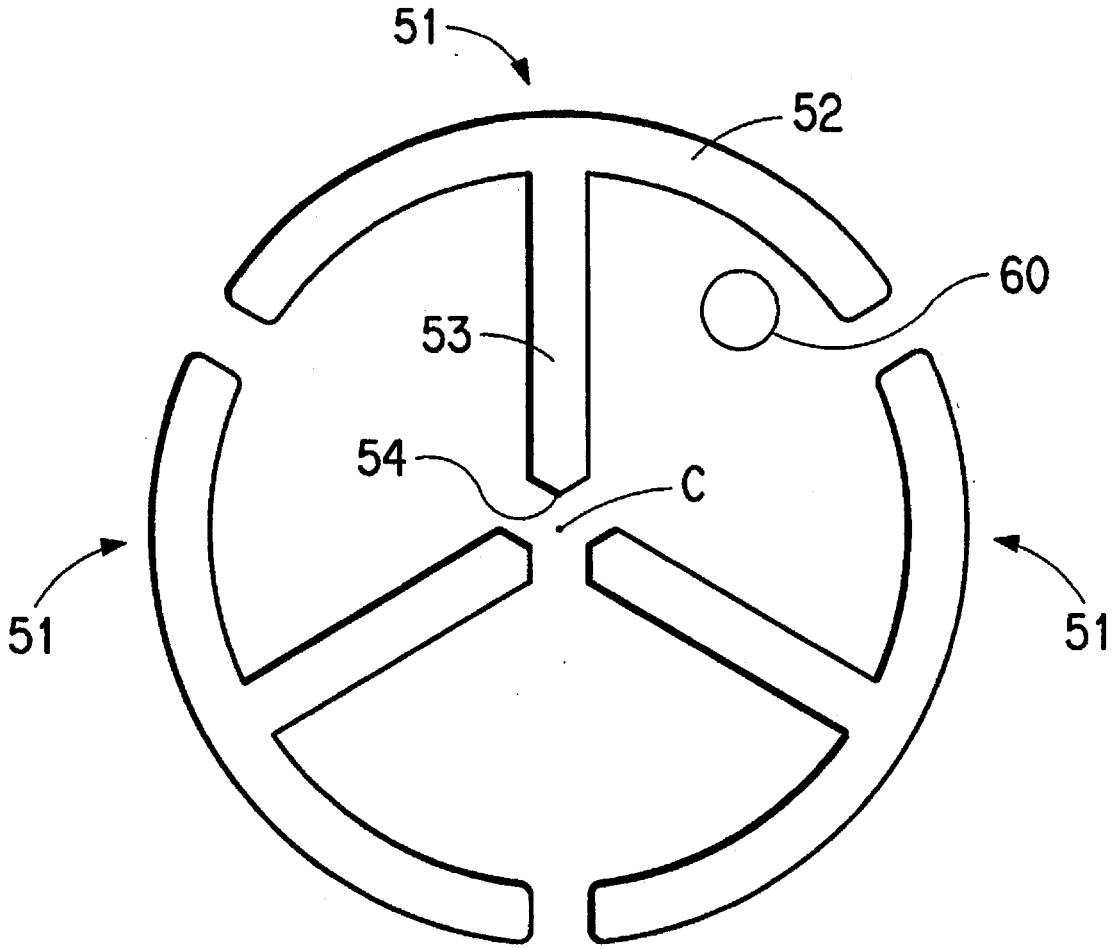
FIG. 9 is an enlarged view of a spinneret capillary, taken looking at the lower face of the spinneret, for spinning preferred 3-void filaments of the invention as in FIGS. 10 and 11.

FIG. 9 shows a spinneret capillary for spinning identifier filaments with three voids. It will be noted that the capillary is segmented, with three segments 51 disposed symmetrically around an axis or central point C. Each segment 51 consists of two slots, namely a peripheral arcuate slot 52 and a radial slot 53, the middle of the inside edge of peripheral arcuate slot 52 being joined to the outer end of radial slot 53, so each segment forms a kind of "T-shape" with the top of the T being curved convexly to form an arc of a circle. Each peripheral arcuate slot 52 extends almost 120 deg. around the circumference of the circle. Each radial slot 53 comes to a point 54 at its inner end. Points 54 are spaced from the central point C. Each peripheral arcuate slot 52 is separated from its neighbor by a distance which is referred to as a "tab". The short faces of neighboring peripheral arcuate slots 52 on either side of each tab are parallel to each other and parallel to the radius that bisects such tab. In many respects, the capillary design shown in FIG. 9 is typical of designs used in the art to provide hollow filaments by post-coalescence spinning through segmented orifices. Points 54 at the inner ends of radial slots 53 are provided in the spinneret capillary design shown in FIG. 9, however, to improve coalescence of the polymer at the center of the filament, i.e., to ensure that the three voids do not become connected. An important and novel difference in FIG. 9 herein (that differentiates from orifice designs of the prior art) is the provision of an orifice 60. Molten polymer extruded through orifice 60 solidifies and coalesces on an internal wall of one of the voids of the filament formed by post-coalescence of molten polymer extruded through slots 51, 52 and 53 to form a protuberance partially filling one of the voids and acting as an identifier when the cross-section of that filament is examined under magnification. The relative location of the identifier protuberance within the void may vary along a length of the filament, as will be understood. Also, as may be understood and as has already been explained for multi-void fibers containing more than three voids, the invention lends itself to many variations. For example, more than void may be partially filled by providing, correspondingly, more than one orifice like orifice 60.

EXAMPLE 4

Filaments were spun from poly(ethylene terephthalate) of relative viscosity (LRV) 20.4, at a polymer temperature of 291°–297° C. at 1277 ypm (1167 mpm), through a spinneret with 363 capillaries, at a throughput per capillary of 0.278 lbs./hr. (0.126 kg./hr.), using capillary orifice designs as shown in FIG. 9. The spun filaments were assembled to form a rope of 65,000 relaxed drawn denier. The rope was drawn in a conventional manner, using a draw ratio of 2.9× in a hot, wet spray draw zone maintained at 95° C. The drawn filaments were crimped to two different levels, to obtain two levels of crimp (and correspondingly two levels of bulkiness, namely Support Bulk, measured as described by Tolliver for carded webs in U.S. Pat. No. 3,772,137, as given for Sample A and for Sample C in TABLE B below), in a conventional stuffer box crimper of cantilever type (1.0 in, 2.5 cm size) and the crimped ropes were relaxed in an oven at 180° C. before cutting. A conventional antistatic overlay finish of about 0.15% per weight was applied to every sample. The resulting filaments were all cut to staple of length 2 inches (5.4 cm).

Figure 10:
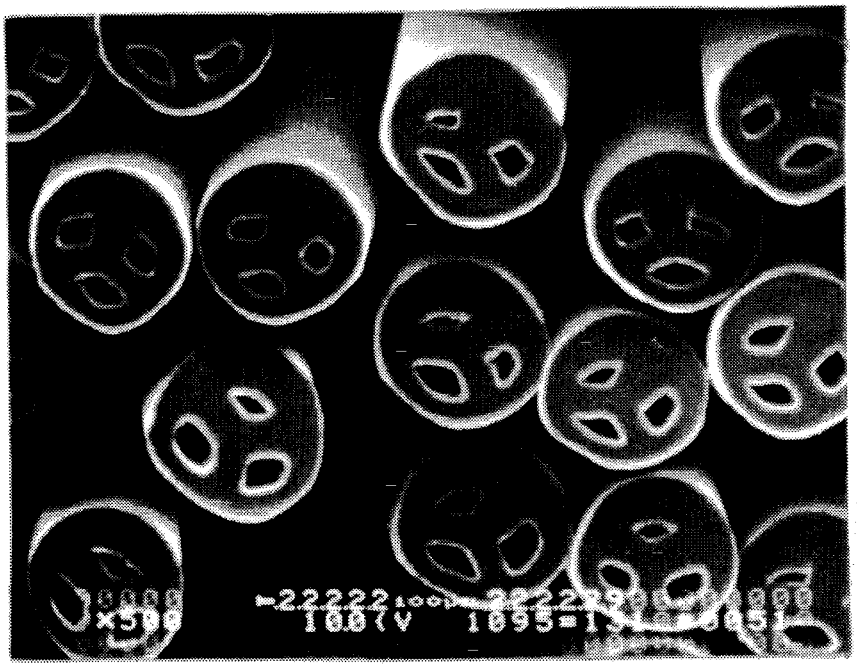
Figure 11:
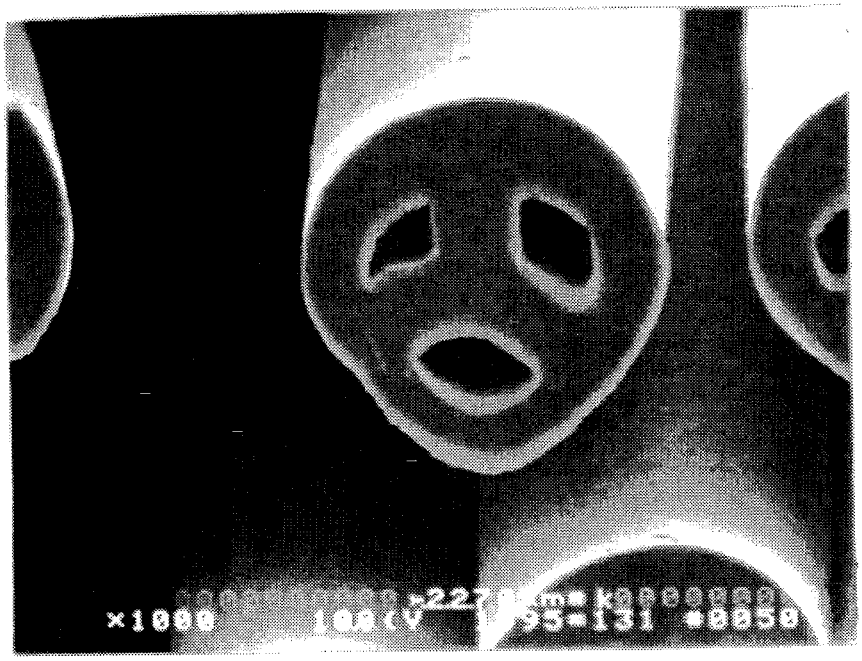

Cross-sections of the resulting cut identifier fibers are shown in FIGS. 10 and 11. Each such filament contains a solid axial core and three parallel continuous voids, one of which contains a protuberance of an inside surface of the void to serve as an identification mark. These fibers have a void content of about 18%.

Figure 12:
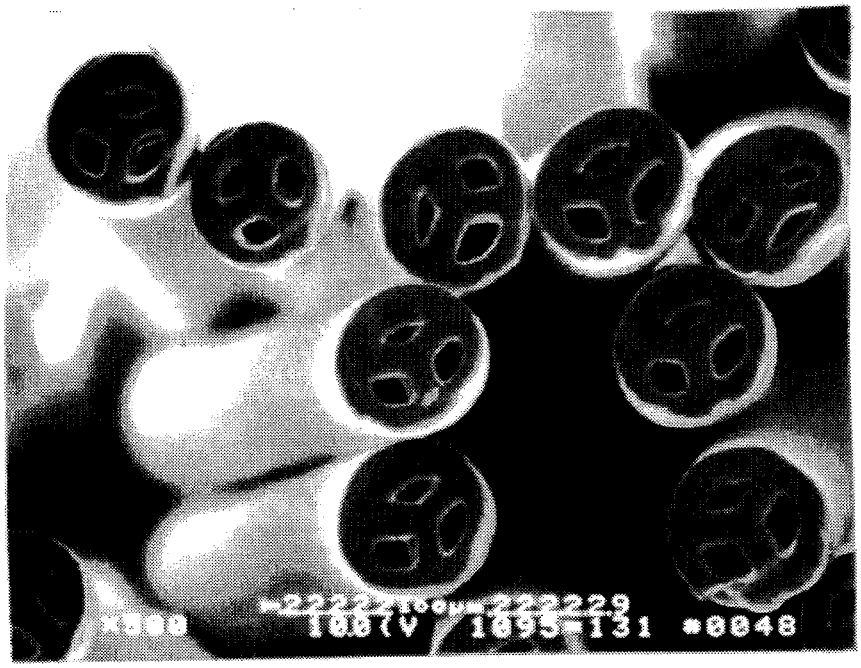
Figure 13:
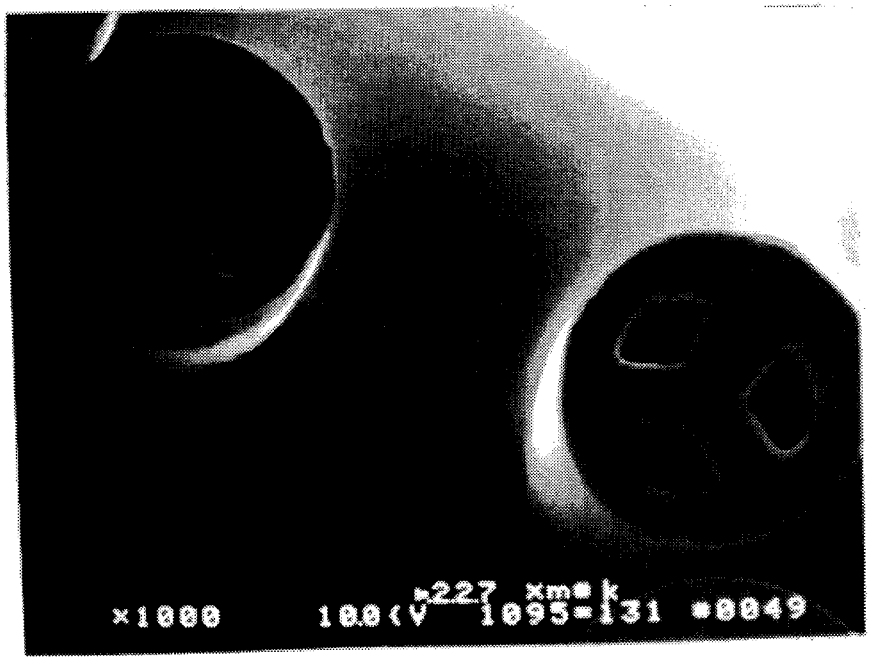

The above fibers were compared with 3-void comparison fibers (crimped to similar levels of crimp, providing similar levels of bulkiness, as described above, as given for Sample B and for Sample D in TABLE B), of the same denier and which were made similarly, except for using a capillary without any extra orifice 60, i.e., a capillary as described and illustrated in FIG. 2 of aforesaid application Ser. No. 08/315,748. These comparison fibers are shown in FIGS. 12 and 13, and their cross-sections are similar to those of the invention, except that they contain no fiber identification marker, i.e., there are no protuberances that act as identifier marks as shown in FIGS. 10 and 11.

Figure 14:
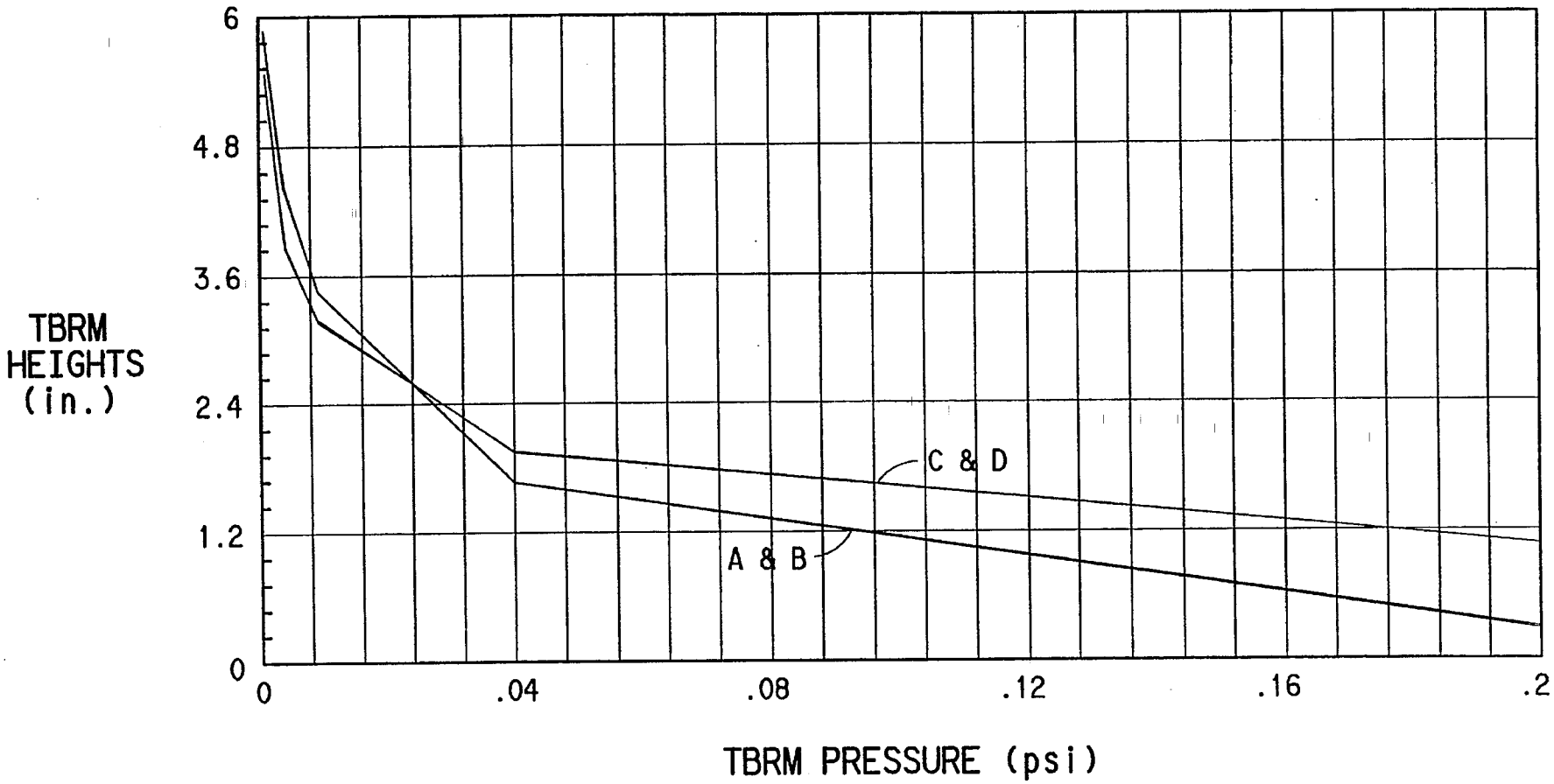
FIG. 14 is a graph plotting TBRM data, heights in inches versus pressure in psi, as discussed also in Example 4.

Sample A (identified fibers) and Sample B (comparison fibers) were crimped to similar crimp levels of about 4.5 crimps per inch (CPI), and to a Crimp Index (CHI) of about 7. Table B shows that the TBRM data measured for such Samples are very similar, so much so that, when the data points are plotted on a graph, as shown in FIG. 14, Curves A and B are extremely close together. Similarly, Sample C (identified fibers) and Sample D (conventional fibers) were crimped to similar crimp levels of about 7.5 crimps per inch (CPI), and to a similar Crimp Index (CHI) of about 11, and give similar TBRM results (see Table B and FIG. 14). In other words, when these two types of fibers are crimped to similar crimp levels (similar CPI and CHI), the resulting bulkiness of the fibers (as measured by TBRM) is virtually indistinguishable, despite the differences in their cross-sections, which are visible in magnified photographs, as shown in FIGS. 10 to 13.

TABLE B

| Pressure | Height (inches) under such Pressure | | | |
|---|---|---|---|---|
| (psi) | Sample A | Sample B | Sample C | Sample D |
| 0.001 | 5.873 | 5.925 | 5.46 | 5.419 |
| 0.005 | 4.412 | 4.419 | 3.932 | 4.006 |
| 0.010 | 3.497 | 3.473 | 3.208 | 3.251 |
| 0.040 | 1.694 | 1.643 | 1.952 | 1.972 |
| 0.20 | 0.535 | 0.550 | 0.861 | 0.861 |

Figure 15:
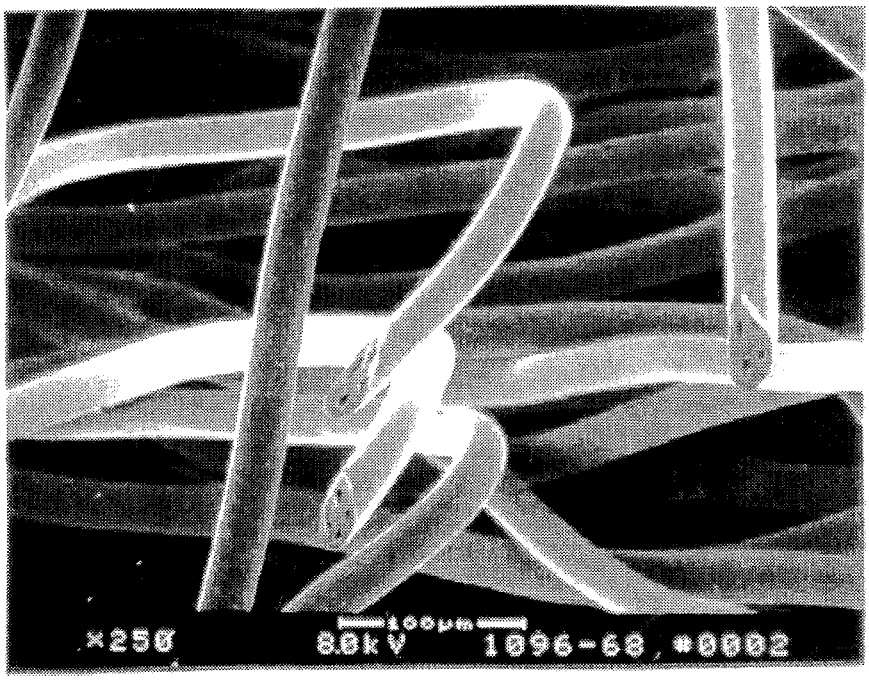
FIGS. 15 and 16 are magnified photographs showing not only cross-sections of preferred fibers of the invention, but also that the fibers are crimped, as described later herein.
Figure 16:
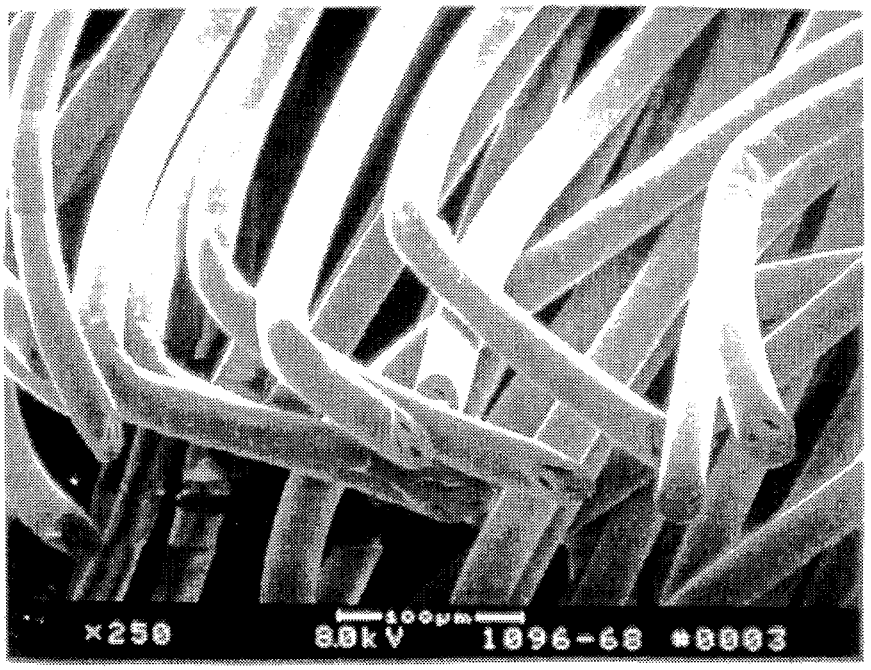

In all the above comparative tests, where the bulkiness of fiberfill comprising identifier fibers of the invention was compared with the bulkiness of fiberfill comprising fibers of similar cross-section except that all voids were clear (i.e., without identifier), the crimping of each set of fibers that were compared was carried out in the same stuffer-box machine under the same conditions (using the same velocity, temperature profile and pressures). FIG. 15 is a magnified photograph of crimped 4-void fibers according to the invention, showing some 4-void cross-sections somewhat similarly to those in the (magnified) photographs in FIGS. 1, 4, and 5, except that more of the fiber can be seen so this photograph can show that these fibers have indeed been crimped conventionally, using such a stuffer-box. Similarly, FIG. 16 is a (magnified) photograph like that in FIG. 15, except of crimped 3-void fibers according to the invention.

The multi-void fibers of the invention may be processed into products such as batts and fiberballs (sometimes referred to as clusters) and further processed into pillows, filled apparel, comforters, cushions and like bedding and furnishing material, as disclosed in the art, including that specifically mentioned herein, and art such as LeVan U.S. Pat. Nos. 3,510,888, and 4,999,232, and various Marcus patents, including U.S. Pat. Nos. 4,618,531, 4,783,364, 4,794,038, 4,818,599, 4,940,502, and 5,169,580, and U.S. Pat. No. 5,088,140 (Belcher et al). Although, hitherto, most fiberfill has comprised cut fiber, such as has been disclosed above, there has been growing commercial interest in using deregistered tows of continuous filaments as fiberfill, as disclosed for example by Watson in U.S. Pat. Nos. 3,952,134 and 3,328,850. Accordingly, application of the invention to fiberfill in the form of deregistered tows of continuous filaments is also contemplated herein, and the invention is not confined to cut fibers nor to fiberfill comprising such cut fibers. Additionally, as well understood in the art, it has been commonplace to mix or blend fibers for use as filling material. Accordingly, it is contemplated that fiberfill according to the invention may consist essentially entirely of identifier fibers according to the invention, or these identifier fibers may be mixed with other fibers; thus, the fiberfill filling material may be identified by all or a portion of its fibers being such identifier fibers. Reference is made in this regard to my copending applications Ser. No. 08/458,945 (DP-4711-C) and Ser. No. 08/459,189 (DP-4711-B), being filed simultaneously herewith, the disclosures of which are hereby expressly included herein by reference, and which solve the problem of identifying and differentiating hollow filling fibers (containing a single continuous void throughout their fiber length) and fiberfill comprising such filling fibers. Fiberfill, as is well understood by those skilled in the art, is shorthand for fiberfill filling material, or more shortly fiber-filling material, and refers to a bulky mass of fibers used to fill articles, such as pillows, cushions and other furnishing materials, including other bedding materials, such as sleeping bags, mattress pads, quilts, comforters, duvets and the like, and in apparel, such as parkas and other insulated articles of apparel, whether quilted or not. Crimp is an important characteristic and provides the bulk that is an essential requirement for fiberfill. Generally, the fibers are crimped by mechanical means, usually in a stuffer-box crimper, as described, for example, in Halm et al. in U.S. Pat. No. 5,112,684. Crimp can also be provided by other means, such as asymmetric quenching or using bicomponent filaments as reported, for example, by Marcus in U.S. Pat. No. 4,618,531 and in U.S. Pat. No. 4,794,038, and in the literature referred to therein, so as to provide "spiral crimp". All this is well understood by those skilled in this art.

I claim:

1. Multi-void fibers that are of a synthetic polymer, that have at least four continuous voids throughout their fiber length, and that have a multi-void cross-section that shows characteristic polymer material that protrudes into one or more of the voids from an inside surface of the void or voids.

2. A fiber according to claim 1, wherein said synthetic polymer is a polyester.

3. A fiber according to claim 1, wherein said synthetic polymer is a polyester, and wherein said characteristic polymer material is also a polyester.

4. Multi-void fibers that are of a synthetic polymer, that have three continuous voids throughout their fiber length, and that have a multi-void cross-section that shows characteristic polymer material that protrudes into one or more of the voids from an inside surface of the void or voids.

5. A fiber according to claim 4, wherein said synthetic polymer is a polyester.

6. A fiber according to claim 4, wherein said synthetic polymer is a polyester, and wherein said characteristic polymer material is also a polyester.

* * * * *